United States Patent [19]

Platt

[11] Patent Number: 4,785,603

[45] Date of Patent: Nov. 22, 1988

[54] INTERLOCKING CROSS TEE

[75] Inventor: William J. Platt, Collingdale, Pa.

[73] Assignee: National Rolling Mills Inc., Malvern, Pa.

[21] Appl. No.: 935,762

[22] Filed: Nov. 28, 1986

[51] Int. Cl.[4] ..... E04B 5/52

[52] U.S. Cl. ..... 52/667; 52/484

[58] Field of Search ..... 52/667, 664–669, 52/484, 726; 403/346, 347

[56] References Cited

U.S. PATENT DOCUMENTS

| | | | |
|---|---|---|---|
| 3,396,997 | 8/1968 | Adams | 52/484 |
| 3,496,690 | 2/1970 | Jahn | 52/232 |
| 3,746,379 | 7/1973 | Sauer . | |
| 3,778,947 | 12/1973 | Sauer | 52/232 |
| 3,846,031 | 11/1974 | Adams | 403/28 |
| 4,108,563 | 8/1978 | Brown et al. | 403/347 |
| 4,161,856 | 7/1979 | Brown | 52/726 |
| 4,208,851 | 6/1980 | Sauer | 52/573 |
| 4,462,198 | 7/1984 | Sharp | 52/667 |
| 4,499,697 | 2/1985 | LaLonde | 52/484 |
| 4,525,973 | 7/1985 | Vukmanic et al. | 52/667 |
| 4,601,153 | 7/1986 | Dunn | 52/666 |
| 4,677,802 | 7/1987 | Vukmanic | 52/667 |

*Primary Examiner*—John E. Murtagh

*Attorney, Agent, or Firm*—Eugene Chovanes

[57] ABSTRACT

In a suspended ceiling grid structure adapted to support ceiling tiles or the like, connecting apparatus between ceiling grid inverted T main and cross members disposed at right angles to each other and having upright central fins and bottom horizontal flanges comprise a tongue extending from each end of the cross members, a locking tab formed in the tongue of the cross members that is V-shaped in cross section and contacts the web of the main member when a cross member has been inserted through a slot in the main member, an opening in the tongue of the cross member that allows the locking tab to flex back when the cross member is inserted through a slot in the main member, a fingernail and fingernail interlocking pocket formed in each end of the cross member to interlock oppositely disposed cross members together and an interlock release pocket formed in the bottom of the fingernail interlocking pocket to disengage interlocked cross members without damage to either cross member.

4 Claims, 4 Drawing Sheets

FIG. 6
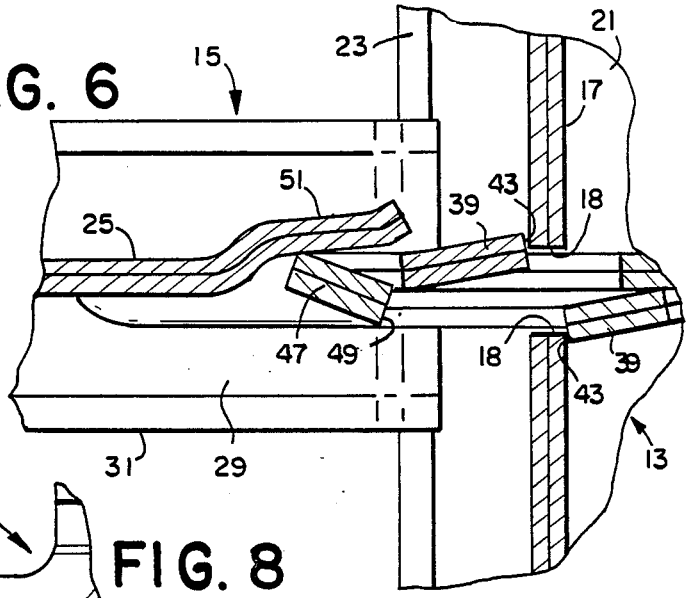
FIG. 8
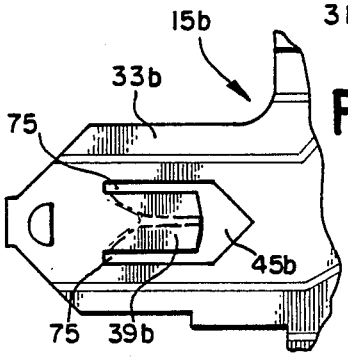
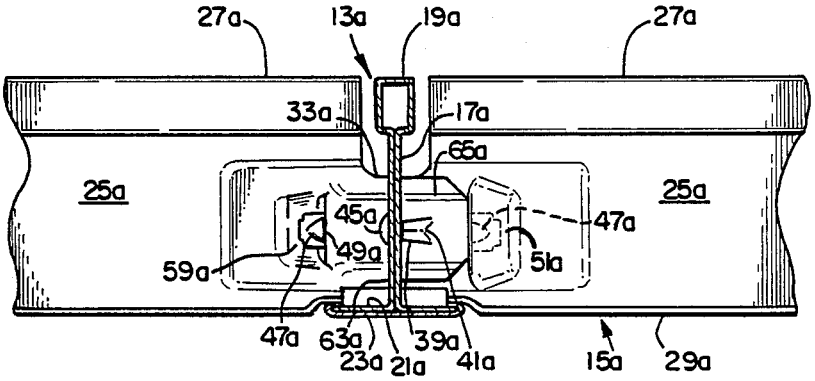
FIG. 7

INTERLOCKING CROSS TEE

BACKGROUND OF THE INVENTION

1. Field of the Invention

This invention relates to improvements in a suspended ceiling grid structure adapted to support ceiling tiles or the like, and more particularly concerns improvements in connecting means between elements of the grid structure.

2. Description of the Prior Art

Suspended ceiling grid structures for supporting ceiling tiles are known in the art. Typically, such grid structures have a plurality of parallel main beams or runners connected together at right angles by a plurality of cross tees. The main beams and cross tees are made of metal that is generally thin, so that even when the main beams and cross tees are constructed with a double thickness of such metal, the connecting means may fail when subjected to high levels of tension, such as the vibrations caused by seismic disturbances.

Various proposals have been made in the prior art for modifying suspended ceiling grid connecting means for accommodating the stress of contraction nd expansion so as to maintain the proper support of ceiling boards even during a condition of excessive vibration as would be caused by a seismic disturbance. The prior art proposals to accommodate, and hence, avoid the adverse effects of undue stress in the connecting means of a cross tee grid structure have involved the use of locking tabs to lock a cross tee to a main beam after the cross tee has been inserted through a slot in the main tee. In addition, the cross tees of such a structure have been made to interlock to increase the resistance of such cross tees to forces tending to pull them apart. However, such connecting means in some instances required the use of clips to lock the connecting means together, or a separate end connector made of higher strength steel shaped to the end of the web.

The use of reinforcing clips to lock the connection between cross tees and main beams of a suspended ceiling structure adds undesirably both to inventory and installation problems as well as to cost of materials. The use of these clips has been necessary, however, because interlocking cross tees and locking tabs of cross tees known in the art have not been strong enough to withstand high compression and tension forces.

Another problem has been how to provide interlocking cross tees with a means for easy disengagement from the interlocked position for removal of such cross tees without damage.

SUMMARY OF THE INVENTION

Accordingly, among the objects of the present invention is the provision of an improved seismic-rated suspended ceiling grid system including main beam and cross tee connecting means that is operatuve to accommodate the stress of the forces caused by excessive vibrations from a seismic disturbance in a manner that does not detract from the rigidity of the grid structure, and its capacity to support the ceiling boards without sagging.

A further object of the invention is the provision of a cross tee featuring a locking tab to prevent pull out of the cross tee from the main beam when a first cross tee is seated in a supporting slot provided in the main beam before a second cross tee is seated in the slot.

Another object of the invention is the provision of an interlocking cross tee featuring an interlocking fingernail and interlocking fingernail pocket to prevent pull out of a cross tee from a similarly constructed but oppositely disposed cross tee seated in an interlocked position.

A further object of the invention is the provision of an interlocking cross tee featuring an interlock release pocket to allow two similarly constructed but oppositely disposed interlocked cross tees to become disengaged from the interlocked relationship without causing damage to the main beam or either cross tee.

In accomplishing these and other objects, improvements are provided which increase the strength at the interconnection or coupling between a cross tee and a main beam, without using heavier gauge metal for the webs of the main beams or using clips to lock a cross tee to a main beam. This improvement in strength is obtained by forming the locking tab on the tongue of a cross tee with a spinal crease so that the locking tab, as it protrudes outwardly in a transverse or lateral direction from the tongue, is V-shaped in cross section. This V shape of the locking tab provides additional strength at the connection between a cross tee and a main beam.

There is also provided an improved cross tee featuring an opening in the tongue to allow the locking tab to flex back when the cross tee is inserted into the slot of a main beam. If this opening is not punched out behind the locking tab, the tab would not be able to flex back because when a tab is punched through sheet metal, the size of the tab is larger than the size of the opening created by the punch.

There is also provided an improved cross tee featuring a fingernail and a fingernail interlocking pocket. Additionally, an interlock release pocket is provided on the bottom portion of the fingernail locking pocket. The interlock release pocket allows two similarly constructed but oppositely disposed interlocking cross tees to become easily disengaged from the interlocked position without damage to either cross tee.

BRIEF DESCRIPTION OF THE DRAWINGS.

FIG. 6 is an enlarged view of a portion of the connecting means shown in FIG. 4;

FIG. 7 is a view partly in section of another embodiment of the invention; and FIG. 8 is a detail view of an alternative embodiment of the connecting tongue of the invention.

DETAILED DESCRIPTION

Figure 1:
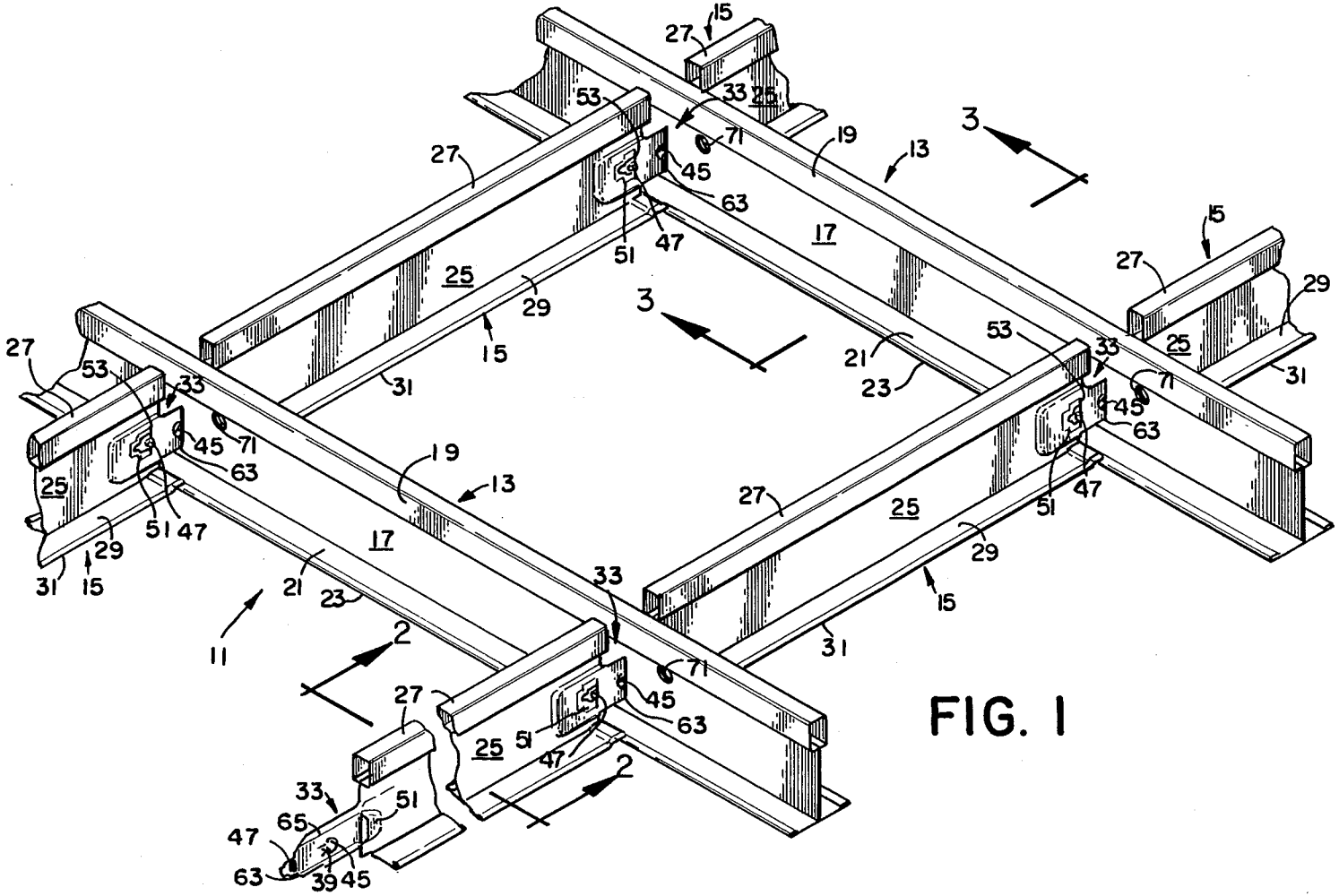
FIG. 1 is a fragmentary view in perspective of a suspended ceiling grid structure constructed in accordance with the invention.
Figure 2:
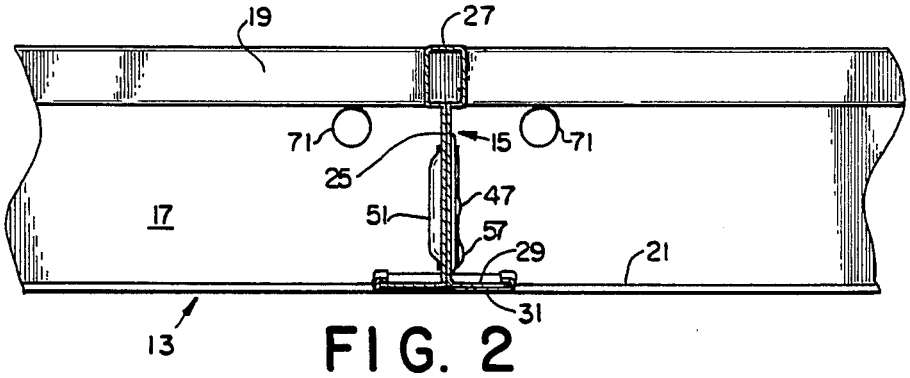
FIG. 2 is a view in section as indicated by the lines and arrows 2—2 which appear in FIG. 1.
Figure 3:
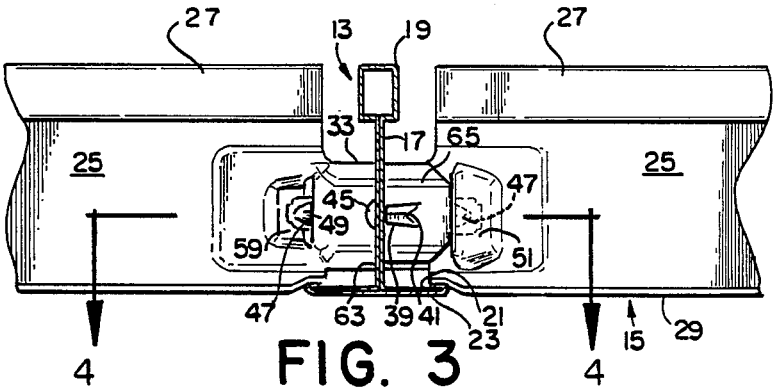
FIG. 3 is a view in section as indicated by the lines and arrows 3—3 which appear in FIG. 1.
Figure 4:
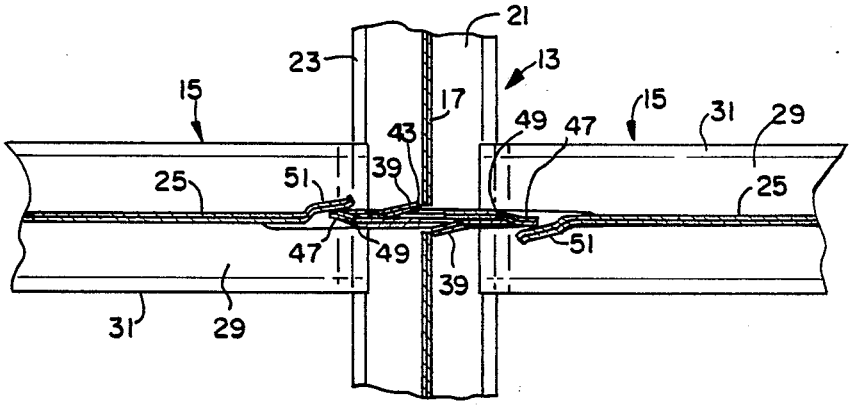
FIG. 4 is a view in section as indicated by the lines and arrows 4—4 which appear in FIG. 3.
Figure 5:
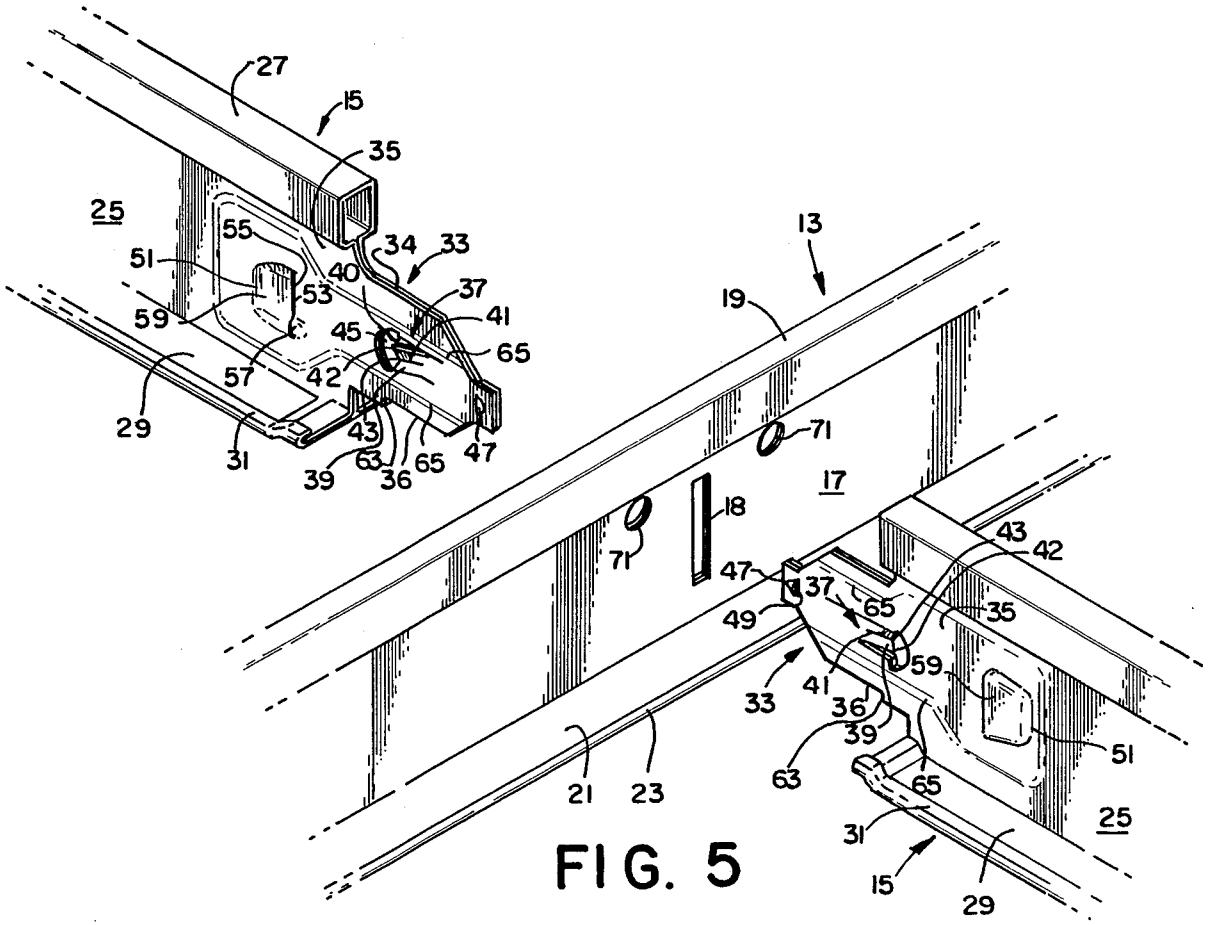
FIG. 5 is a fragmentary view in perspective of two oppositely disposed interlocking cross tees and a main beam before the cross tees are inserted into the main beam.

Turning now to the drawings, there is shown a suspended ceiling grid structure 11 adapted to support ceiling tiles or the like, which comprises a plurality of main beams or runners 13 arranged in spaced-apart, substantially parallel relationship, and cross tees 15 which connect adjacent main beams 13 together.

Each main beam 13 has an inverted T shape, and includes a central fin or web 17 having a reinforced bead or bulb 19 at the top and a pair of oppositely disposed flanges 21 at the bottom. An ornamental cap 23 is mounted on the bottom of flanges 21.

Cross tees 15 are also of inverted T construction and each includes a central fin or web 25, a reinforcing bead or bulb 27 at the top of central web 25, flanges 29 extending from the bottom of central web 25, an ornamental cap 31 mounted on the bottom of flanges 29, and a connecting tongue 33 extending from each end 35 of a web 25. The tongue 33 is preferably offset from the center plane of the web 25 by approximately one-half the thickness of the web 25.

On each tongue 33 of the cross tees 15 is provided a locking means 37, of such configuration that either end of a cross tee 15 may be locked to a slot 18 provided in a main beam 13 to which a cross tee 15 is connected in the suspended ceiling grid structure 11. The locking means 37 on each tongue 33 comprises a locking tab 39 and an opening 45. The locking tab 39 is formed in the tongue 33 and extends laterally outwardly from the tongue 33 to create a locking tab edge 43 whereby when a cross tee 15 is locked to a main beam 13 the locking tab edge 43 of the tongue 33 engages the central web 17 of the main beam 13. A tab spine or crease 41 is formed in the center of locking tab 39 so that the locking tab 39 is V-shaped in cross section, with the locking tab edges 42 extending away from, and the tab spine 41 being close to, the tongue 33. The V-shape in cross section of the locking tab 39 greatly increases the resistance of the cross tee 15 to pull-apart forces.

The opening 45 is formed axially away from the locking tab edge 43 of the locking tab 39 whereby when a tongue 33 is inserted through a slot 18 of a main beam 13, the locking tab 39 flexes back into the cavity 40 it left when the locking tab 39 was punched, and flexes into the opening 45. The opening 45, which is preferably D-shaped, is provided because when a tab 39 is punched through sheet metal, it is larger than the cavity it leaves. If the opening 45 were not present, the locking tab 39 could not flex back when inserted through the slot 18 of the main beam 13, because edge 43 would strike the metal of the web 25.

Each cross tee 15 further includes interlocking means of such configuration that either end of a cross tee 15 may be interlocked with a similarly constructed but oppositely disposed cross tee 15. The interlocking means comprises an interlocking fingernail 47 formed in and extending laterally outwardly from the tongue 33 and in a direction opposite to the projection of locking tab 39. The interlocking fingernail 47 is preferably formed by depressing the metal and making only a vertical cut or incision in the tongue 33 whereby an interlocking fingernail edge 49 is produced.

The interlocking means further includes a fingernail interlocking pocket 51 formed in and extending laterally outwardly from the central web 25 of the cross tee 15. The fingernail interlocking pocket 51 is preferably formed by depressing the metal and making only a vertical cut or incision on the central web 25 of the cross tee 15, which creates a fingernail interlocking pocket edge 53 that has a top portion 55 and a bottom portion 57 for engaging the interlocking fingernail edge 49 of a connecting cross tee 15.

The fingernail interlocking pocket 51 includes an offset or raised portion 59 that extends away from and axially along the central web 25 for a distance to form the pocket, whereby a connecting tongue 33 of an interconnected cross tee 15 is not severely bent or deformed when inserted into the interlocked position.

Another feature of the interlocking means is that the bottom portion 57 of the fingernail interlocking pocket edge 53 is flared laterally outwardly in a direction opposite to the direction of the extension of the fingernail interlocking pocket 51 by an amount approximating the thickness of an interlocking fingernail 47 whereby the tongue 33 of the cross tee 15 and the tongue 33 of a similarly constructed but oppositely disposed cross tee 15 may be disengaged from the interlocked relationship by moving the interlocked cross tees 15, 15 so that an interlocking fingernail 47 of one cross tee 15 passes through the interlock release pocket 57 of the opposite cross tee 15.

Each cross tee 15 additionally includes a tee stop shoulder or notch 63 formed in the bottom edge 36 of tongue 33 for abutting the central web 17 of the main beam 13 when the cross tee 15 is inserted through the slot 18 in the central web 17.

The cross tees 15 are also provided with stiffening ribs 65 that reinforce and greatly strengthen the ends of cross tees 15 and connecting tongues 33.

In the embodiment of the invention shown in FIG. 7, the reinforcing bulb or bead **27*a* of each cross tee 15*a* extends axially to a position where-by when cross tees 15*a* are connected to a main beam 15*a*, the bulbs 27*a* of the cross tees 15*a* more nearly abut the bulb 19*a* of the main beam 13*a***.

FIG. 8 shows another embodiment of the invention where two slits 75 are formed in the tongue **33*b* of the cross tee 15*b*. The slits 75 are formed above and below the locking tab 39*b* and provide additional clearance so that the sides of the locking tab 39*b* do not strike the metal of the tongue 33*b* when the locking tab 39*b* flexes back into the cavity 40*b* as the cross tee 15*b* is inserted through the slot 18 of the main beam 13. The opening 45*b* of this embodiment is triangle-shaped, and is contiguous with the slits 75 so that the opening 45*b* and the slits 75** have a combined U-shaped appearance.

Hanger holes 71 are formed in the central web 17 of main beam 13, and are adapted to receive wire hangers that support the grid structure.

In operation, main beams 13 are suspended from the ceiling by wire hangers attached to hanger holes 71, and cross tees 15 are locked to main beams 13 by sliding the connecting tongues 33 through slots 18 so that the locking tab edges 43 and tee stop shoulders 63 abut central web 17 of main beam 13. Additionally, the connecting tongues 33 slide into the fingernail locking pockets 51 of oppositely disposed cross tees 15 far enough so that the edge 49 of the interlocking fingernail 47 slides over and then abuts or engages the edge 53 of the fingernail interlocking pocket 51.

When the suspended ceiling grid structure 11 is subjected to severe tension as caused by the excessive vibrations of a seismic disturbance, the locking tab 39 of a cross tee 15 exerts pressure against the central web 17 of the main beam 13. Also, the interlocking fingernail edge 49 of a cross tee 15 exerts pressure against the fingernail interlocking pocket edge 53 of a similarly constructed but oppositely disposed interlocked cross tee 15. Further, interlocking fingernail 47 of a cross tee 15 exerts pressure against the raised portion 59 of the fingernail interlocking pocket 51 of a similarly disposed interlocked cross tee 15.

ADVANTAGES

The suspended ceiling grid structure 11 of the present invention is provided with increased strength at the interconnection or coupling between a main beam 13 and a cross tee 15, such increased strength being obtained without the use of heavier gauge metal for the webs 17 of the main beam 13 or the use of clips to lock a cross tee 15 to a main beam 13. This improvement in strength is obtained from the interlock between fingernail 47 and interlocking pocket 51.

There is also provided an improved cross tee 15 featuring an opening 45 on a tongue 33 to allow the locking tab 39 to flex back when the cross tee 15 is inserted into the slot 18 of a main beam 13. If this opening 45 is not punched out behind the locking tab 39, the locking tab 39 would not be able to flex back because when a tab is punched through sheet metal, the size of the tab is larger than the size of the opening created by the punch.

There is also provided an improved cross tee 15 featuring an interlocking fingernail 47 and a fingernail interlocking pocket 51. When two similarly constructed but oppositely disposed cross tees 15 are interlocked, the resistance of the interlocked cross tees 15 to pull-apart forces is greatly increased. Additionally, an interlock release pocket 57 is provided in the bottom portion of the fingernail interlocking pocket edge 53. The interlock release pocket 57 allows two similarly constructed but oppositely disposed cross tees 15 to become easily disengaged from the interlocked position without any damage to either cross tee 15.

I claim:

1. A cross tee having an inverted T cross section for use in a suspended ceiling grid structure, comprising an elongated central web with a bulb at the top and with a pair of oppositely disposed flanges extending outwardly from the bottom of the web and adapted to support ceiling tiles, .

a connecting tongue extending from an end of the web, the tongue being offset from the center of the web by approximately one-half the thickness of the web, locking means formed in the tongue for locking said cross tee to a slot provided in a main beam to which the cross tee is connected in the ceiling grid, an interlocking means formed in the tongue for interlocking the cross tee with interlocking means of a similarly constructed but oppositely disposed cross tee when the cross tees are inserted into the slot from opposite directions, and an interlock release means for disengaging the tongues of two similarly constructed but oppositely disposed interlocked cross tees from the interlocked relationship, wherein the interlock release means comprises an interlock release pocket formed in the bottom portion of the fingernail locking edge by a laterally outward flare of the bottom portion, the flare being approximately the thickness of the interlocking fingernail, whereby the tongue of the cross tee and the tongue of a similarly constructed but oppositely disposed interlocked cross tee may be disengaged from the interlocked relationship by moving the interlocked cross tees relative to one another so that an interlocking fingernail passes through the interlock release pocket of the opposite cross tee.

2. A cross tee having an inverted T cross section for use in a suspended ceiling grid structure, comprising an elongated central web with a bulb at the top and with a pair of oppositely disposed flanges extending outwardly from the bottom of the web and to support ceiling tiles, a connecting tongue extending from an end of the web, the tongue being offset from the center of the web by approximately one-half the thickness of the web, locking means formed in the tongue for locking said cross tee to a slot provided in a main beam to which the cross tee is connected in the ceiling grid, an interlocking means formed in the tongue for interlocking the cross tee with interlocking means of a similarly constructed but oppositely disposed cross tee when the cross tees are inserted into the slot from opposite directions, and an interlock release means for disengaging the tongues of two similarly constructed but oppositely disposed interlocked cross tees from the interlocked relationship, wherein the locking means includes a locking tab formed in and extending laterally outwardly from the tongue thereby creating a locking surface facing away from the end of said tongue, and an opening positioned in the tongue at the end of the locking tab, wherein the interlocking means comprises an interlocking fingernail formed from and extending laterally outwardly from the tongue in a direction opposite to the projection of the locking tab thereby creating an interlocking surface facing away from the end of the tongue, and a fingernail locking pocket formed in and extending laterally outwardly from the cross tee web in the same direction as the interlocking fingernail thereby creating a fingernail locking edge, wherein the interlock release means comprises an interlock release pocket formed in the bottom portion of the fingernail locking edge by a laterally outward flare of the bottom portion, the flare being approximately the thickness of the interlocking fingernail, whereby the tongue of the cross tee and the tongue of a similarly constructed but oppositely disposed interlocked cross tee may be disengaged from the interlocked relationship by moving the interlocked cross tees relative to one another so that an interlocking fingernail passes through the interlock release pocket of the opposite cross tee.

3. The cross tee of claim 2, wherein the bottom edge of the tongue includes a tee stop shoulder for stopping the cross tee from traveling too far through the web of the main runner.

4. The cross tee of claim 2 wherein the tongue includes longitudinal ribs to strengthen the locking means and the interlocking means.

* * * * *